United States Patent [19]

Rich

[11] Patent Number: 4,627,579

[45] Date of Patent: Dec. 9, 1986

[54] PARTICLE CHARGING AND COLLECTING SYSTEM

[75] Inventor: Stanley R. Rich, Wellesley Hills, Mass.

[73] Assignee: Advanced Energy Dynamics, Inc., Natick, Mass.

[21] Appl. No.: 617,319

[22] Filed: Jun. 5, 1984

Related U.S. Application Data

[63] Continuation-in-part of Ser. No. 520,649, Aug. 5, 1983, abandoned.

[51] Int. Cl.[4] ..... B02C 19/00

[52] U.S. Cl. ..... 241/79.1; 209/129; 241/275

[58] Field of Search ..... 209/644, 68, 127–131; 241/24, 79.1, 5, 39, 40, 275

[56] References Cited

U.S. PATENT DOCUMENTS

| | | | |
|---|---|---|---|
| 2,119,886 | 6/1938 | Myers | 241/40 |
| 2,466,371 | 4/1949 | Byrd, Jr. | 209/128 |
| 2,723,029 | 11/1955 | Lawver | 209/127 C |
| 2,818,358 | 12/1957 | Brownell et al. | 241/40 X |
| 3,308,944 | 3/1967 | Chamberlain et al. | 209/129 X |
| 3,476,243 | 11/1969 | Ferrara et al. | 209/129 |
| 3,567,141 | 3/1971 | Zbraniborski et al. | 241/275 X |

FOREIGN PATENT DOCUMENTS

| | | | |
|---|---|---|---|
| 660714 | 5/1979 | U.S.S.R. | 241/24 |
| 722583 | 3/1980 | U.S.S.R. | 209/127 C |

*Primary Examiner*—Mark Rosenbaum

*Attorney, Agent, or Firm*—Wolf, Greenfield & Sacks

[57] ABSTRACT

A mixture of particles of different materials is further comminuted by rubbing contact while moving at high relative velocity along a surface of a solid body to a substantially smaller size range during which the particles of different materials acquire a very high differential charge, and while bearing such high differential charge the particles of different material are entered into an electric field for efficient separation of particles of one material from particles of another material.

14 Claims, 7 Drawing Figures

PARTICLE CHARGING AND COLLECTING SYSTEM

RELATED APPLICATION

This is a continuation in part of application Ser. No. 520,649 filed Aug. 5, 1983, now abandoned.

BACKGROUND OF THE INVENTION

This invention relates in general to the physical separation of constituents of a mixture of particles, more particularly to improvements in methods and means for separating constituents of a mixture of ultra-fine particles which do not exceed about 100 microns in size. The invention is applicable to a wide variety of physical mixtures, as well as to the beneficiation of ores. It has been found to be particularly useful in the separation of impurities from coal, i.e.: coal beneficiation, and to prepare ultra-fine pulverized coal for burning in boilers designed for burning fuel oil or natural gas.

The constituents of coal which are considered to be "impurities" include those containing sulfur and some minerals which form non-combustible ash. Ash-forming constituents coat, foul and drastically reduce the efficience of heat transfer in boilers, in addition to polluting the environment. Sulfur-bearing constituents contribute to environmental pollution, one form of such pollution being commonly referred to as "acid rain". As found in its natural state, coal contains varying proportions of these impurities, the proportions in any one deposit depending on the geological history of that deposit.

Coal beneficiation begins with a process of crushing, pulverizing, or comminuting coal, to break pieces of coal down to particles of smaller and smaller sizes, which frees the constituents from one another and thereby enables them to be separated. Eventually, this process yields particle sizes so small that the cost and difficulty of handling the product become formidable barriers to further progress. Finely-comminuted coal particles can be confined in a liquid slurry for further treatment, but that approach requires the use of water or other liquid, which adds to the cost and complexity of the separation process and therefore is not economically or logistically desirable on a commercial scale. Dry separation processes, among which processes for separating charged particles in an electric field in a gaseous medium (e.g.: roll-collectors with "corona" charging) are highly desirable, suffer the limitation that coal comminuted so fine (smaller than 37 microns or 400 mesh) as to be like a powder, blows around in a dust-like cloud of fine particles and is very difficult to deposit on a rotating roll-collector; it contributes a potential source of explosion which can be initiated by a spark in the apparatus. Yet, the finer the coal is comminuted the greater is the portion of the impurity constituents that can be physically freed for eventual separation from the coal.

Similar problems are encountered in the beneficiation of phosphate ores, which are mined in a matrix comprised of pieces of phosphate rock and silica admixed in a clay-like material known as "slimes." The matrix material must be disintegrated as much as possible in order to efficiently recover phosphate rock. In the process, significant quantities of ultrafine particles (slimes) are produced. Prior art beneficiation methods cannot separate ultrafine particles efficiently or effectively.

This invention teaches new methods and means for electrically charging and finely comminuting constituents of coal and other ores to powder-like ultra-fine particles sizes (e.g.: smaller than 100 microns), and for electrically charging a mixture which includes ultra-fine particles, so as to enable particles of impurities and particles of coal, phosphate or other desired component, or constituents of any such mixture, to be separated from each other in an electric field in particle size ranges smaller than have heretofore been separable on a commercial scale in an electric field in a gaseous medium.

GENERAL NATURE OF THE INVENTION

Particulate matter in a gaseous medium can be electrically charged in many ways. The present invention employs a unique particle charging and comminuting mechanism which imparts unexpectedly high differential electrical charges to particles in a pulverized mixture of an ore component (e.g.: coal, phosphate, metallic compounds) and impurities (in sizes ranging from 250 microns to zero) while fracturing and further comminuting the particles in the mixture to sizes generally finer than 37 microns. This is done by moving the mixture along a surface of a solid body in a rubbing contact with the surface at a high velocity relative to the surface, or otherwise impacting the surface so that the particles in the mixture are fractured and further reduced in size, increasing the number of particles at least about 25 percent in the process. This further comminution distinguishes the present invention from the prior art. In this process as applied to coal the particles of organic materials (primarily coal) are charged positively, and the particles of inorganic materials (primarily ash forming minerals and pyrite) are charged negatively.

Unexpectedly, the levels of charge imparted by the process are extremely high, such that upon dropping the mixture charged in this way into the space between two plate-like electrodes approximately two inches apart having, for example, a potential difference of approximately 10,000 volts d.c. (which is equivalent to 2000 volts per cm) between them the charged particles are so strongly attracted to the respective oppositely-charged plates that within a few inches of entering the space between the plates nearly total collection of the coal constituent on one plate and the impurities constituent on the other plate occurs. In an apparatus employing a rubbing surface to practice this new process, the rubbing surface became charged to a level so high that a spark was seen to leap from it to a grounded object five inches away through dry air. This is equivalent to about 250,000 volts. This unexpectedly high voltage exceeds by five orders of magnitude the few electron volts available from tribo-electric charging alone. Slowly-rotating electrically-charged roll-collectors or the like are advantageously employed in a continuous separation and collection process according to the present invention.

THE PRIOR ART

Friction and impacting of ore particles on or against each other or a third material, is known to be useful to put an electrical surface-charge on particles for subsequent electrostatic collection. U.S. Pat. Nos. 2,114,682; 2,723,029; and 3,493,109 are illustrative. They describe friction and impacting schemes without particle disintegration, including use of the triboelectric effect. Published accounts of attempts to apply tribo-electric charging of coal feedstock in a process for separating the coal and impurity constituents in an electric field in a gaseous medium uniformly report only marginal beneficiation of the coal. The tribo-electric effect, as known in the art (U.S. Pat. No. 3,493,109), derives differential electric charging of particles in a mixture from contact between the particles and one or more materials having different work functions from those of the particulate materials. Selective tribo-electric charging of (e.g.:) two different mineral species takes place only when those mineral species are brought into contact with a suitable surface, the work function of which lies between those of the respective mineral species. In order to have a tribo-electric charge the contact surface must not be polluted by other material which could interfere with the surface reactions. The level of tribo-electric charge achieved by the various particles is small, being dependent in each case on the difference of a few volts or tenths of volts in work functions of the particle material and the material of the contact surface. The mixture of particles charged by tribo-electric contact is only partially separated in one pass through a path between two oppositely charged plate-like electrodes standing about 45 feet high. A large portion of the mixture of charged particles falls through the electric field in each pass, without being deflected to and collected on or near either of the electrodes, thus becoming "middlings". It is necessary to recycle middlings several times in order to achieve any meaningful separation.

DETAILED DESCRIPTION OF THE DRAWINGS

Figure 4:
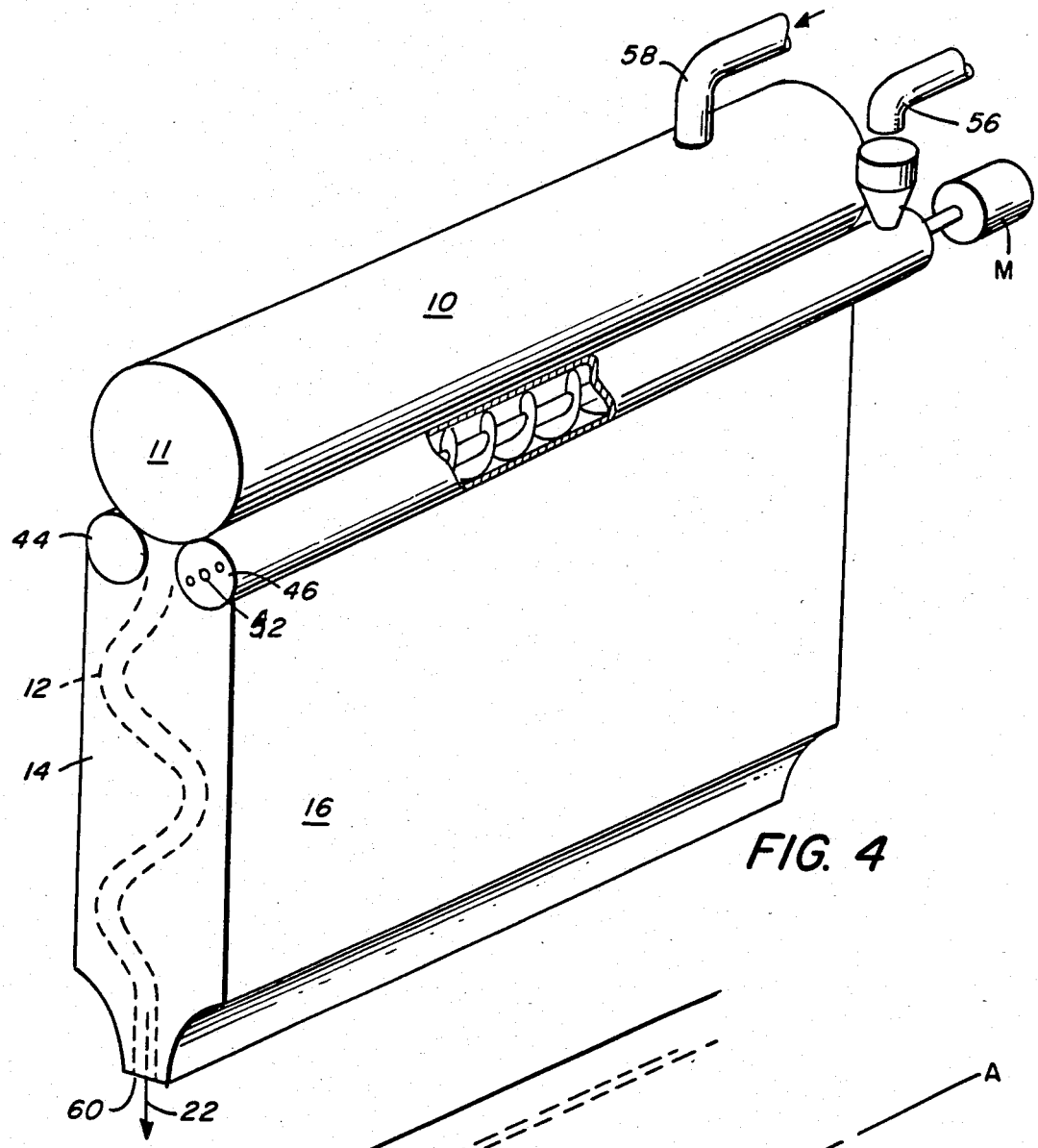
FIG. 4 is an isometric view of the particle-charging portion of the system shown in FIG. 1.

The system shown in FIGS. 1–4 is intended for treating large volumes of particulate matter per unit of time in a continuous separation and collection process. A particle-charging component includes a plenum 10 closed at its ends 11 and arranged to blow air or other gas at high velocity through a sinuous path 12 between two solid bodies 14, 16 having confronting undulating surfaces 18, 20, respectively, which define the sinuous path 12. Preferably, the sinuous path is a series of alternatively-reversed half-circle paths. As is shown in FIG. 4, the plenum 10 and the path 12 are elongated transverse to the direction 22 of gas flow through the sinuous path. A pair of feed screws 40, 42 in tubular housings 44, 46, respectively are arranged along the sides of the plenum 10 where it couples to the beginning of the sinuous path 12. Each tubular housing couples to the beginning of the sinuous path via holes 50, 52, respectively, in its wall. Each screw is turned by a suitable motor "M". Feed-coal inputs 54, 56, respectively, are provided into each tubular housing 44, 46. A gas input 50 is provided into the plenum 10. Output from the sinuous path 12 is via an elongated, slot-like opening 60 between the lower ends of the two solid bodies 14, 16.

A charged-particle collection component includes a pair of spaced-apart elongated roll-collectors 70, 72 with wiper blades 71, 73, respectively, beneath the output slot 60 so that output from the sinuous path 12 will fall between them. Collection bins 74, 76 with a partition vane 78 between them are located beneath the roll collectors. A motor M-1 is fitted to each roll collector 70, 72, respectively, for turning the roll collectors in mutually-opposite directions, as represented in this example by arrows 75, 77, respectively. For collecting charged particles, one roll-collector 70 is charged positively and the other 72 is charged negatively, thereby establishing an electric field between them. The same field can be established if one of the roll-collectors, e.g.; 70, is grounded.

Operation of the particle-charging component of the system is as follows:

Air (or other suitable gas, such as nitrogen) is fed into plenum 10 via its input 58, while coal which has been comminuted to the range approximately 250 microns to zero is fed into the feed screws 40, 42 via the feed-coal inputs 54, 56, respectively. The motors M are operated to distribute pulverized coal into the beginning of the sinuous path. At the same time gas enters the sinuous path from the plenum 10, mixing with the pulverized coal. The pressure of gas in the plenum is adjusted to blow the coal so fast that it rubs with higher shear against the walls 18 and 20, continuously changing direction not only as it would in a cyclone, but also owing to th alternating-reversed-curved configuration of the sinuous path. With a suitably-high gas velocity it is found that the particles of coal are smaller in size at the output opening 60 than the particle size of the input feed-coal at the feed-coal inputs 54, 56. Table I following sets forth measured particle-size reduction on three different coal samples that were treated in this manner. In each case, the mass median diameter, in microns, was measured using a Coulter counter. To illustrate, the first sample, Helvetia, input feed coal had a mass median diameter of 40.53 microns, and the particles exiting from the output opening were found to have a mass median diameter of 26.71 microns (collected coal "product") and 28.70 microns (collected "rejects").

TABLE I

| COAL SAMPLE | MASS MEDIAN DIAMETER, (MICRONS) |
|---|---|
| Helvetia Feed | 40.53 |
| Helvetia Products | 26.71 |
| Helvetia Rejects | 28.70 |
| Moss #1 Feed | 36.06 |
| Moss #1 Products | 28.74 |
| Moss #1 Rejects | 24.58 |
| Upper Freeport Feed | 40.58 |
| Upper Freeport Products | 27.30 |
| Upper Freeport Rejects | 23.18 |

The number of particles increases as the inverse of the cube of the diameter, i.e.: by a factor of 4, approximately. In the process of doing that, part of the energy used is transferred into electric charge.

When the gas pressure in the plenum is adjusted to obtain comminution of the input particulate manner to a substantially smaller size during the particle-charging process as is exemplified in Table I, an unexpectedly-high level of particle charge is achieved, which exceeds by up to five orders of magnitude the level of charge that would be expected from simple contact between materials in the tribo-electric effect. Additional evidence of the high level of charge achieved is that substantially all of the particulate matter exiting from the output opening 60 is sparated and collected in an electric field as formed between the roll-collectors 70, 72, for example. By contrast, if the pressure of gas into the sinuous path 12 from plenum 10 is reduced to that sufficient to cause the particles to rub or impact on the surfaces 18, 20 without the result of further comminution being observed most of the coal particles fall through the roll-collectors 70, 72 without separation or collection.

Figure 1:
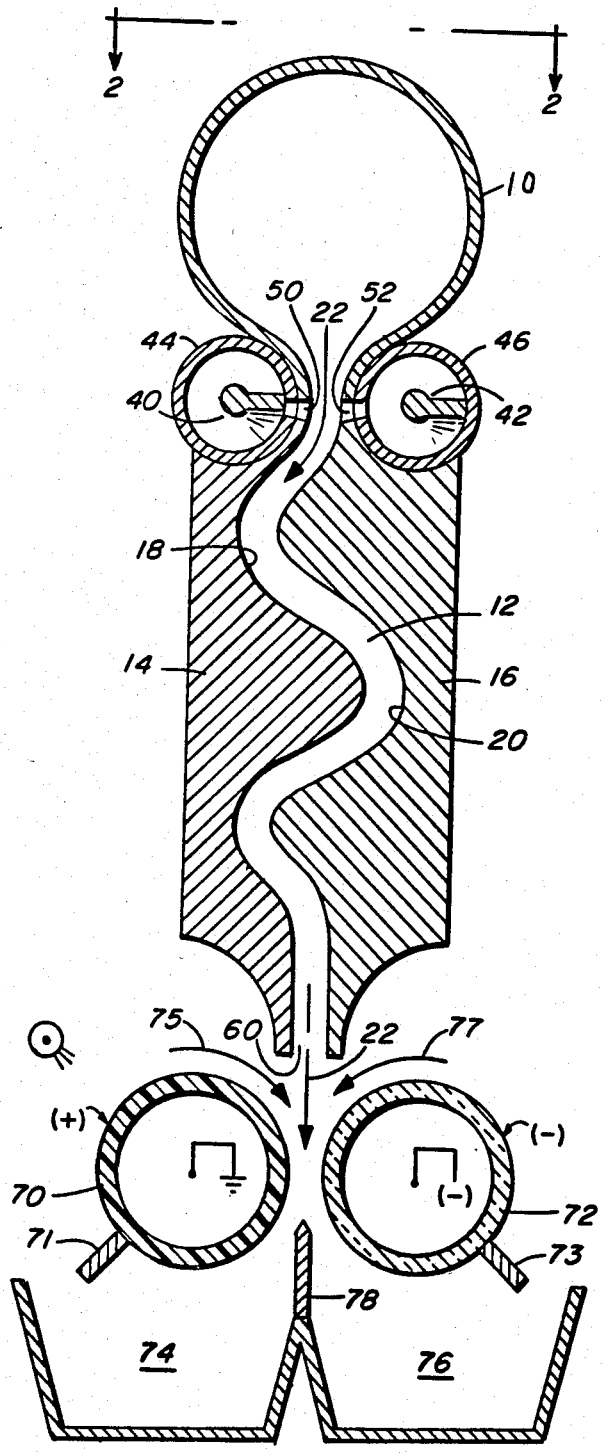
FIG. 1 is a vertical-section view of a particle separation and collection system according to the invention.
Figure 2:
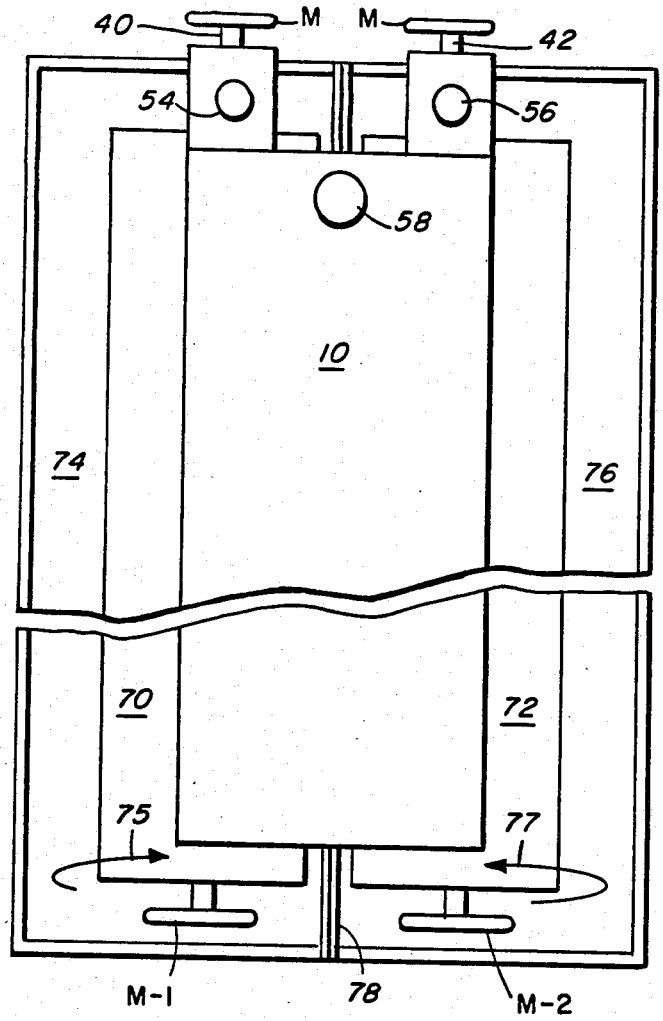
FIG. 2 is a top view taken on line 2—2 of FIG. 1.
Figure 3:
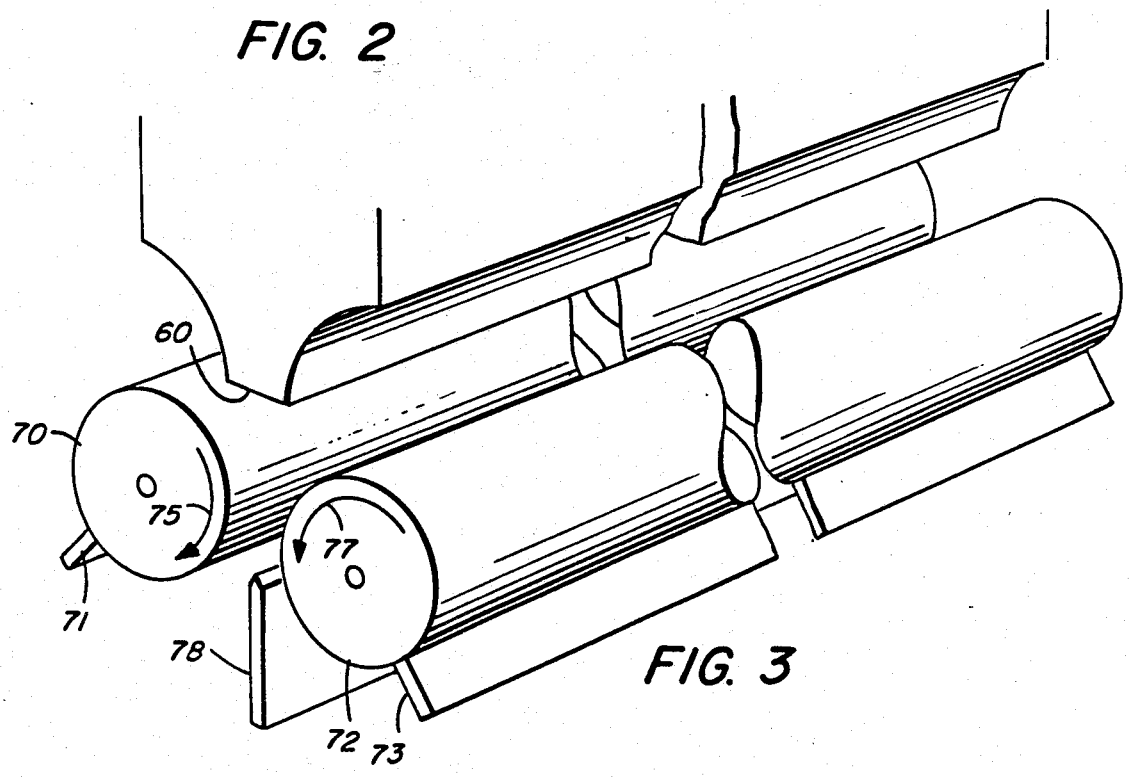
FIG. 3 is an isometric view of the roll-collector portion of the system shown in FIG. 1.

With this invention the materials of which the solid bodies 14, 16 are made need not be selected for tribo-electric properties, but can instead be chosen for ability to withstand destruction under impact and erosion from the particles. A ceramic material is represented in FIG. 1. Other materials useful to construct particle charging systems of the invention are steel, copper, carbides, nitrides, borides, various ceramics and glass. As a practical matter, abrasion-resistant materials are preferred. Such materials can be selected among ceramics, carbides, nitrides, borides, and refactory metas such as iridium and osmium, as examples. Such abrasion-resistant materials can be supported on other materials, which can be chosen for other properties or for reasons of economy.

It is estimated to require particle velocity in the range of or exceeding about 200 ft./sec. relative to the contact or rubbing surface to achieve further comminution and enhanced electrical charging of the feed coal particles according to the invention.

The charged-particle collections component of the system is also designed for a high volume system throughput. The roll-collectors 70, 72 extend axially substantially the lenght of the output opening 60. The rolls turn toward each other as "seen" from the output opening. It is found that, when the gas velocity is sufficiently high, as described above, substantially all of the particles exiting from the output opening are separated and collected almost immediately, the coal particles on the negative electrode 72 and the impurities on the positive electrode 70. Unlike the fast-rotating drum in a typical prior-art electrostatic separator, the roll collectors 70, 72 are turned slowly (about 15 r.p.m.) and the collected materials are removed by the wiper blades 71, 73 to fall into the bins 74, 76, respectively. There are virtually no middlings. The power requirement for turning the roll collectors is small; motors M-1 can be clock motors.

Figure 5:
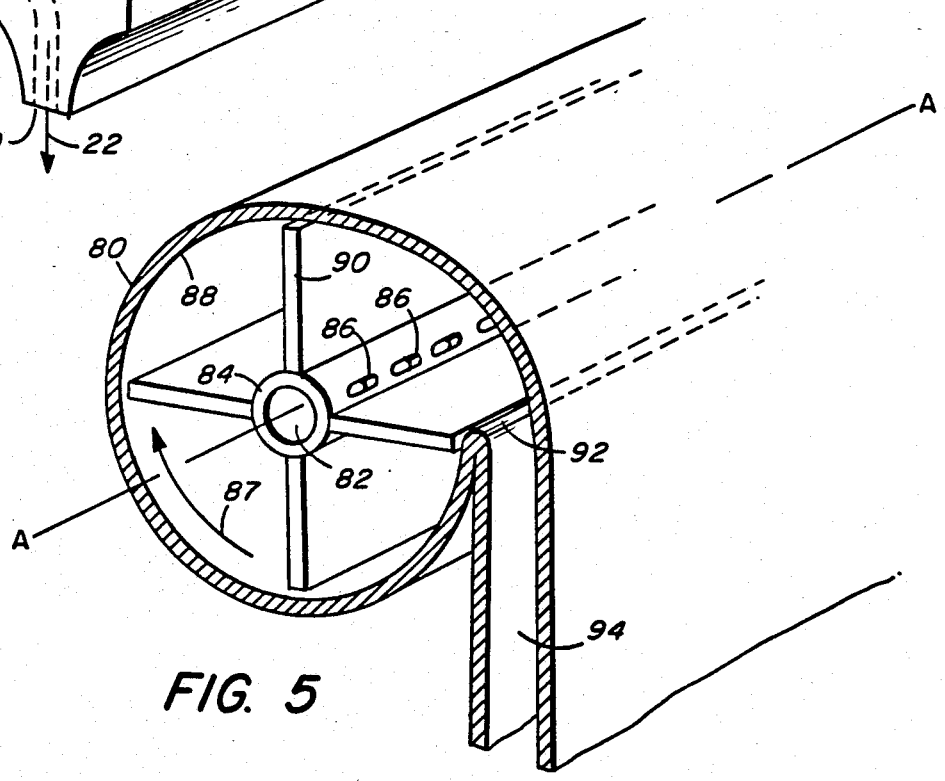
FIG. 5 is an isometric view of another particle-charging system according to the invention.
Figure 6:
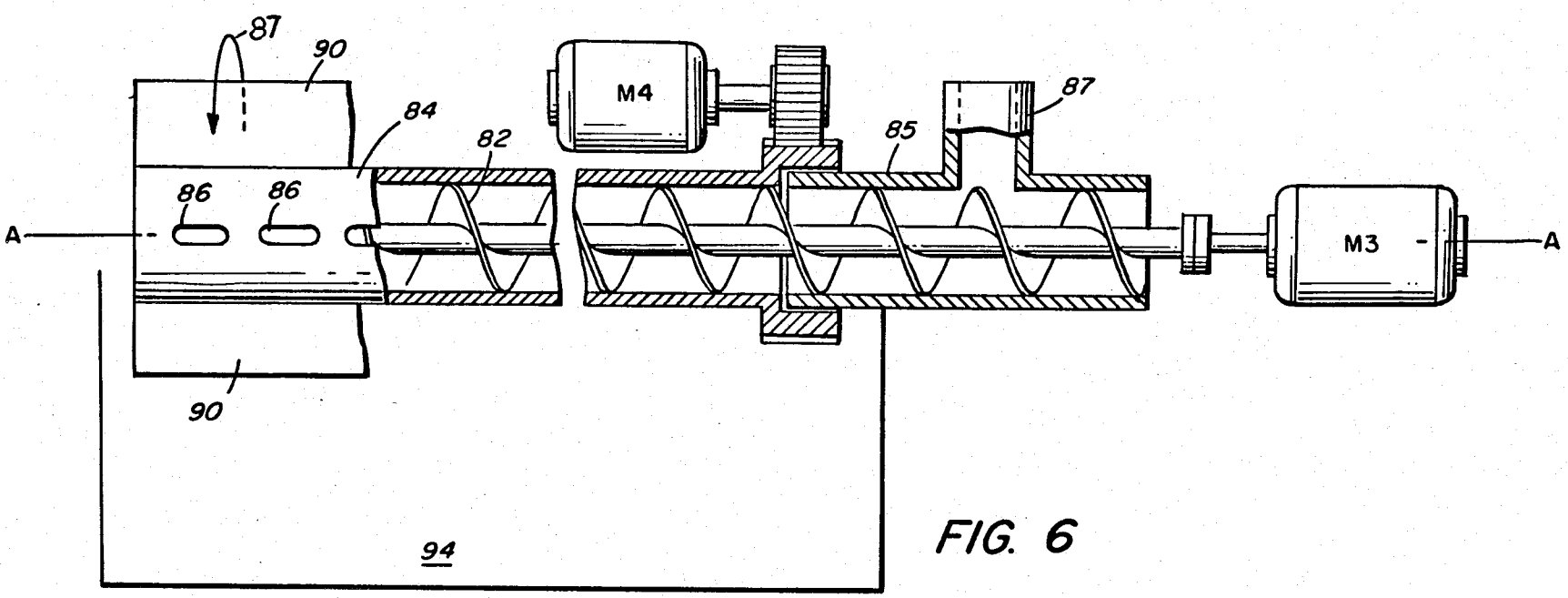
FIG. 6 is an axial partial section showing the feed mechanism in FIG. 5.

Preferably, one of the roll collectors is coated with an insulating material, to minimize the possibility that a spark might discharge the energy stored in the large capacitance that will exist between the two large roll collectors 70, 72. In this case a charge can be placed on the insulated roll with a corona 69, or with a wiper (not shown). It has been observed that a non-conductive material providing the positively-charged surface (as is illustrated at roll 70 in FIG. 1) gave the best separation results. Impurities are collected on the positive electrode where, some of them being electrical conductors, they can lose their original negative charge and then be attracted to the negative electrode. If the positively-charged collector surface is on a non-conductor the impurities will not lose their negative charge, and will remain on the positive electrode. FIG. 5 illustrates another particle-charging component according to the invention. A plenum 80 has a coal-feed screw 82 inside an apertured hollow tubular shaft 84 which, in turn, is axially fitted inside the plenum. The screw 82 and the shaft 84 are each separately rotatable on a common axis A—A, as by motors M3 and M4, respectively (FIG. 6), so that particulate matter supplied to the feed screw is fed out the hollow shaft 84, through holes 86 arranged in it along its axis, when the hollow shaft is rotated, in this instance clockwise as shown by an arrow 87. A non-rotatable section 85 of hollow shaft coaxially extending from an end of the rotatable hollow shaft 84 surrounds the input end of the screw 82 and supports a feed hopper 87. The rotatable shaft is fitted with vanes 90 which carry particles of the coal-impurities mixture to the inner wall 88 of the plenum 80 when the hollow shaft 84 and the vanes 90 are rotated. The vanes preferably reach close to the inner wall 88. The plenum has an output slot 92 to which an output conduit 94 is fitted. The output of particulate matter from the conduit 94 can be supplied to a charged-particle collection component like that shown in FIGS. 1–4.

A mixture of coal and impurities comminuted to the range approximately 250 microns to 0 is introduced and distributed, via the screw 82 and holes 86, to the interior of the plenum 80. The shaft 84 and vanes 90 are turned on the axis A—A, and the mixture particles are cast out from the axis to the inner wall 88 where they are accelerated by the vane tips to the requisite velocity for further comminution and electrical charging in motion along the inner wall 88 of the plenum 80. Assuming a desired particle velocity of (e.g.:) 200 feet per second relative to the inner wall, and a plenum diameter of 13 inches, the vanes 90 and shaft 84 should rotate at a speed of about 3600 r.p.m. to accelerate the feed coal particles to that velocity. The charged particles exit through the conduit 94.

Figure 7:
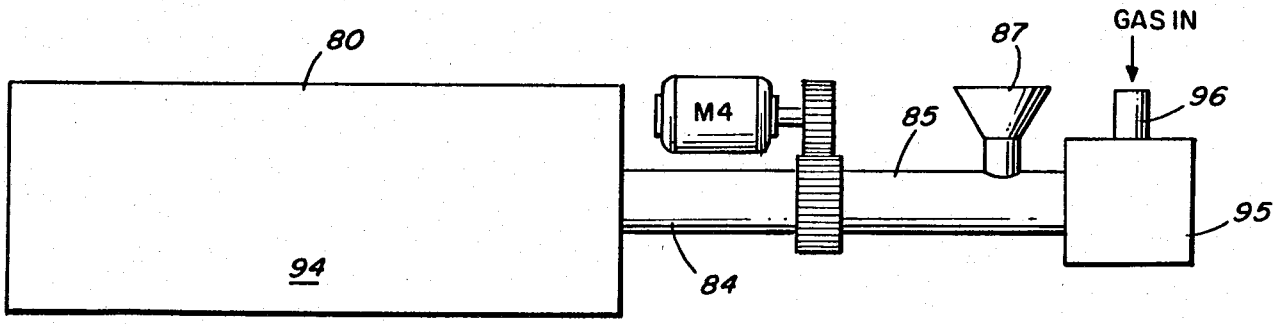
FIG. 7 is an axial view of an alternative feed mechanism.

In FIG. 7, the non-rotatable hollow shaft 84 with hopper 87 is fitted at its remote end with a plenum 95 into which a pressurized gas may be introduced via a conduit 96. This gas drives the input particulate matter from the hopper into the rotatable hollow shaft 84, which distributes it to the plenum 80.

Whereas prior-known physical coal-cleaning methods are not able to clean coal particles smaller than 37 microns, the present invention can remove ash and pyrite from pulverized coal particles in sizes ranging from approximately 250 microns to zero. The following Table II shows data obtained on certain coals. The notes following Table II are an integral part of the information presented in the table.

TABLE II

| | % sulphur | | % Ash | |
|---|---|---|---|---|
| Coal sample | feed | product | feed | product |
| 1. coal-liquid mixture | 1.46 | 0.90 | 6.5 | 1.8 |
| 2. INDIANA III | 4.06 | 2.59 | 13.0 | 2.2 |
| 3. MOSS #1 | 0.64 | 0.64 | 5.97 | 2.52 |
| 4. HELVETIA | 0.94 | 0.82 | 4.32 | 1.92 |
| 5. UPPER FREEPORT | 0.94 | 0.64 | 14.22 | 1.60 |

NOTES:

(a) Samples 1 and 2 were precleaned by conventional heavy medium separation methods; the coal feed in each sample was 100% smaller than 44 microns (325 mesh)

(b) Samples 3 and 4 also were precleaned by conventional methods. The coal feed in each sample was pulverized and dry classified to 100% smaller than 53 microns (270 mesh).

(c) Sample 5 was "run-of-mine" - no precleaning had been done on it. This feed-coal was pulverized and dry classified to 100% smaller than 53 microns (270 mesh).

(d) Samples 1–4, inclusive, results were obtained on one pass through the separation process of the invention. Sample 5 results were obtained on two passes through the process.

The invention has been demonstrated able to clean bituminous coals down to ash levels in the 1-3% range. The invention is thus shown capable of producing "superclean" coal. Having regard to the fact that Bunker-C fuel is permitted to have an ash content up to 3% and the fact that the invention produces, for the first time in a dry process, coal having an ash content substantially less than 3%, in particle sizes ranging from approximately 250 microns down to zero, the coal product of the invention can be burned in diesel engines and in oil-designed boilers; it can be used and the invention contemplates that it will be used to form a constituent of liquid slurry boiler feed, for example. The invention is useful to provide ultra-fine pulverised coal suitably for use in boilers designed for fuel oil or natural gas, since it has been shown to reduce drastically the percentage of ash and other inpurities in the coal.

The invention is capable also of removing so-called "inherent" ash from certain southern-hemisphere coals. For example, the Candiota coal found in Brazil has only 4,700 BTU/lb., and heretofore has been incapable of being burned except in an oil flame. After being cleaned of "inherent" ash a sample was found to have 10,200 BTU/lb., and was capable of being burned without any assistance from petroleum. The "inherent" ash in the Candiota coal is in the form of finely-divided clay distributed uniformly throughout the combustible organic portions of the coal.

The cost of cleaning coal with the process of the present invention is low, approximately 6-8 cents per ton. Electric energy required to operate the dry-process apparatus of the invention is about $\frac{1}{3}$ KWH/TON of coal (plus losses due to friction). While ash levels as low as 1.5 to 3% in coal can be obtained by chemical cleaning, or by use of various forms of agglomeration such as freon agglomeration, these are costly processes which as is noted above, are not desirable economically or logistically on a commercial scale.

The invention is useful in beneficiation of a wide variety of ores, such as minerals which suffer the loss of valuable constituents as "fines." In minerals beneficiation of copper, nickel and zinc, as examples, the froth flotation process that is in current use sends fines to tailings. The present invention is capable of recovering ultra-fine particles of minerals; it is, indeed, useful wherever there is a requirement for handling ultra-fine particles, including the separation of components in a mixture of ultra-fine particles not involved in ore-beneficiation, as the following examples illustrate. In each case, the starting particle size was 37 microns or less.

1. Equal quantities of mustard-colored vanadium pentoxide and blue colored copper sulfate were mixed together, resulting in a greenish-colored mixture. This mixture was separted in one pass through a system like that in FIGS. 1-4, inclusive, operated as described herein, into two materials having the original colors. That is, vanadium pentoxide was collected at one of the collector electrodes and copper sulfate was collected at the other. There was only about 5% vanadium pentoxide remaining in the collected copper sulfate and about 5% copper sulfate remaining in the collected vanadium pentoxide.

2. Equal quantities of white baking flour and pulverized coal were mixed, resulting in a gray-colored mixture. Similarly processed through the same system, a slightly off-white flour constituent was collected at one electrode, and an essentially black constituent was collected at the other.

3. Equal quantities of white baking flour and buff-colored talcum powder were mixed into a sand-colored mixture. Upon being separated in the same manner as the previous examples, a white-powder was collected on one collector electrode and a buff-colored powder was collected on the other.

In the second and third examples, the degree of separation of the constituents of each mixture was estimated by the colors of the respective constituents. It was noted that the ultra-fine constituents appeared to be even finer after collection and separation.

Prior art pulverization techniques are known to be cost-limited, in that the power required to drive grinding mills increases with increasing fineness of pulverization, and in coal-fired utilities, for example, prior attempts to obtain the benefits of efficient combustion that ultra-fine coal can provide have had to yield to the costs of grinding so as to balance the increase of power cost against the savings made possible by finer grinding for the particular coal being fired. This has led to the present practice of using feed-coal mixtures only 65 to 70 percent of which will pan through a 200-mesh sieve. "Micronizing"—i.e.: pulverizing coal to ultra-fine sizes—costs 2 to 5 times as much as conventional coal grinding. The present invention makes ultra-fine particle mixtures at lower costs than prior-art grinders, and it separates them electrically virtually for the same lower cost.

I claim:

1. Apparatus for the benefication of a finely-comminuted feed coal which includes both coal and impurity constitutents comprising a tubular envelope providing a contact surface, means rotatable within said envelope to bring said feed coal into contact with said surface, including means within and extending along the axis of said envelope to supply said feed coal to said rotatable member, and means to rotate said rotatable member at an angular speed sufficient to accelerate said feed coal to a velocity relative to said surface sufficient to fracture and further comminute the feed coal and to impart respective high differential electical charges to the coal and impurity constituents of said feed coal, and, located down-stream of said contact surface, for receiving the output of said further comminuted and differentially charged constituents, electrical means to separate the coal constituent physically from the impurity constituent.

2. Apparatus according to claim 1 in which one of said electrodes comprises an electically non-conductive material, and the apparatus includes means to place an electric charge on a surface of said non-conductive material for collecting one of said constituents.

3. Apparatus according to claim 1 including means to supply said feed coal substantially continuously to said contact surface, and means to remove each of said collected constituents substantially continuously from said separating means.

4. Apparatus according to claim 1 including means to accelerate particles of said feed coal to a velocity of approximately 200 ft./sec. relative to said contact surface.

5. Apparatus according to claim 1 in which said body is made of an abrasion-resistant material selected from the following group - ceramics, carbides, nitrides, borides and refractory metals.

6. Apparatus according to claim 5 in which said abrasion-resistant material is supported on a different material.

7. Charging apparatus for simultaneously further comminuting and electrically charging particles of a feed-coal which has been pulverized to the size range approximately 250 microns and smaller, comprising a tubular envelope having a contact surface, means within and extending along the axis of said envelope to supply said feed coal, and means rotatable within said envelope to accelerate particles of said feed coal in a path in rubbing contact along said surface, said supply means being arranged to supply said feed-coal to said means to accelerate while the later is rotating at a speed sufficient to cast said particles toward said contact surface and at the same time to accelerate said particles along said surface to a velocity which is sufficient to fracture said particles to a substantially smaller size range so as to increase the number of output particles by a factor of at least 20 percent (1.25) approximately and to impart to said particles differential electric charges sufficiently high to enable the coal particle and the impurity particles to be physically separated one from the other substantially immediately upon entering an electric field of approximately 2000 volts per centimeter, and electrical means to separate the coal particles physically from the impurity particles.

8. Apparatus for further comminuting and electrically charging the particles of a finely-comminuted particulate material comprising: a substantially tubular envelope having an interior contact surface, means within and extending along the axis of said envelope for supplying to the envelope an input of particulate materials to be further comminuted and electrically charged, and means rotatable within said envelope for accelerating said particulate materials into rubbing contact along said surface at a relative velocity sufficient to fracture said particles to a range of sizes having a mass median diameter smaller than about 37 microns and to electrically charge said particles.

9. Apparatus according to claim 8 in which the material providing said contact surface is an abrasion-resistant material.

10. Apparatus according to claim 8 comprising means to supply said particulate material to said means to accelerate while the latter is rotating at an angular velocity sufficient to cast said particles toward said contact surface and at the same time to accelerate said particles to said relative velocity along said contact surface.

11. Apparatus according to claim 10 including means to rotate said means to accelerate at an angular velocity sufficient to accelerate said particles to a relative velocity of at least approximately 200 feet per second along said contact surface.

12. Apparatus according to claim 8 having an output for said charged particles and closely adjacent said output electrode means providing an electric field of approximately 2000 volts per centimeter.

13. Apparatus according to claim 8 wherein said relative velocity is at least approximately 200 feet per second.

14. Apparatus according to claim 8 having from said envelope for exit of the charged particles, and closely adjacent said output passage, disposed to receive said charged particles, electrode means providing an electric field of approximately 2000 volts per centimeter.

* * * * *